United States Patent [19]

Breuer et al.

[11] Patent Number: 4,583,785

[45] Date of Patent: Apr. 22, 1986

[54] MINERAL WINNING PLOUGH

[75] Inventors: Oswald Breuer, Dortmund; Gerhard Merten, Lünen; Bernd Steinkuhl, Lünen; Christoph Rassmann, Lünen, all of Fed. Rep. of Germany

[73] Assignee: Gewerkschaft Eisenhutte Westfalia, Lünen, Fed. Rep. of Germany

[21] Appl. No.: 598,253

[22] Filed: Apr. 9, 1984

[30] Foreign Application Priority Data

Apr. 14, 1983 [DE] Fed. Rep. of Germany ..... 3313502

[51] Int. Cl.[4] ..... E21C 27/32

[52] U.S. Cl. ..... 299/34; 299/43

[58] Field of Search ..... 299/29, 34, 43

[56] References Cited

U.S. PATENT DOCUMENTS

| | | | |
|---|---|---|---|
| 3,361,479 | 1/1968 | Löbbe | 299/34 |
| 3,785,703 | 1/1974 | Frenyo et al. | 299/34 |
| 4,209,199 | 6/1980 | Oven et al. | 299/34 |
| 4,243,268 | 1/1981 | Löbbe et al. | 299/34 |
| 4,492,410 | 1/1985 | Schlüsener et al. | 299/34 |

FOREIGN PATENT DOCUMENTS

| | | | |
|---|---|---|---|
| 0877885 | 4/1953 | Fed. Rep. of Germany | 299/34 |
| 2621382 | 12/1977 | Fed. Rep. of Germany | 299/34 |
| 0976057 | 11/1982 | U.S.S.R. | 299/43 |

*Primary Examiner*—Stephen J. Novosad
*Assistant Examiner*—William P. Neuder

[57] ABSTRACT

A coal plough has an elongate plough body which is provided with cutters at each end. The plough body is supported at each of its two ends, by a flat narrow skid on a plate of a plough guide. The skids constitute wear-resistant members and are connected to the plough body in a readily replaceable manner. The skids are so shaped that they guide the plough in the lower zone of the plough guide, and establish connection between the plough and the plough drive chain.

23 Claims, 7 Drawing Figures

VII
VII

MINERAL WINNING PLOUGH

BACKGROUND TO THE INVENTION

This invention relates to a mineral winning plough, and in particular to a coal plough.

As is known, a coal plough is movable to and fro on a guide alongside the face of a longwall working. The guide is usually attached to a scraper-chain conveyor, and the plough has a plough body provided with cutters which strip coal from the face. The plough is driven to and fro by means of an endless drive chain attached to the plough body. The plough body is provided with groups of cutters at each end thereof, so that coal can be won in each direction of plough travel. The plough guide, which is constituted by a plurality of individual guide sections, houses upper and lower chain ducts which house the plough drive chain. The plough drive chain is connected to the plough body in the lower chain duct. Typically, the guide includes an inclined plate which projects towards the face and is braced against the floor of the working. This plate defines a guide track on which the heavy plough body runs. Usually, it also serves as a means for limiting the cut of the plough. (See GB-PS No. 1 459 980, U.S. Pat. Nos. 4,035,025, 4,179,161 and 4,403,809).

Known ploughs are subjected to considerable wear as a result of sliding frictional engagement with their plough guides. The service life of known ploughs is, therefore, limited. When a plough body becomes worn, it has to be replaced in its entirety, and this involves considerable labour and time.

The aim of the invention is to provide a mineral winning plough which has improved wear-resistance properties, and an increased service life.

SUMMARY OF THE INVENTION

The present invention provides a mineral winning plough adapted to be moved to and fro alongside a mineral face on a plough guide, the plough having a plough body provided with cutters, wherein the plough body is provided with detachable, wear-resistant skid means which, in use, make sliding engagement with the plough guide.

Preferably, the plough body is elongate, and a pair of wear-resistant skids constitute the skid means, the skids being positioned at the end portions of the elongate plough body. Thus, the elongate plough body is supported, at each of its two ends, on a skid. Consequently, the great weight of the plough is supported on the plough guide by means of the skids which, therefore, take up the wear to a large extent. The skids are arranged on the plough body to be readily replaceable so that, upon becoming worn, they can be removed without great difficulty and replaced by new skids. Since the skids can be replaced after a certain degree of wear has occurred, they expediently consist of relatively small, simply-shaped parts which are not provided with cutters. Instead, cutters are mounted only on the plough body and/or on components mounted thereon. The skid preferably consist of flat elements, the vertical dimension of each of which is considerably less than that of the plough guide, and the width of each of which is expediently likewise considerably less than the width of the plough body.

Advantageously, each of the skids is pivotally connected to the plough body for pivotal movement about an axis parallel to the longitudinal axis of the plough body. The connection between the plough body and the skids is such that the skids are movable below the plough body to a sufficient extent to enable them to adapt themselves to the line of the plough guide which, in the usual manner, consists of individual sections which can be angled towards each other in the vertical plane and/or the horizontal plane. The articulated support of the plough body on the narrow flat skids is similar to that used for mounting a rail vehicle on front and rear bogies.

In a preferred embodiment, a respective coupling member is formed integrally with each of the skids, the coupling members constituting means for connecting the plough to a plough drive chain. The skids, therefore, also provide the connection between the plough body and the plough drive chain. In this case, the arrangement is expediently such that each of the skids embraces the lower portion of the plough guide in a shape-locking manner, thereby providing a lower guide for the plough.

In a preferred embodiment, the plough body has recesses for accommodating the skids, the recesses being open towards the lower face of the plough body. Advantageously, the plough body overlaps the skids at the face side. The skids are, therefore, concealed behind the face-side limiting zone of the plough body. Conveniently, the recesses in the plough body are also open towards that of its sides presented to the plough guide. Preferably, each end portion of the face side of the plough body is provided with an arcuate guide, and a respective floor cutter holder is associated with each of the arcuate guides.

Advantageously, each of the skids is provided with an open-topped bearing surface which engages a respective base member of the plough body.

Preferably, each of the skids is connected to the plough body by means of releasable locking means, whereby the plough body can be lifted away from the skids when the locking means are released. Thus, when the skids become worn, the entire plough body with the cutters mounted thereon can be lifted away from the skids (after release of the locking means) by means of hoisting tackle. Then, with the help of the plough drive chain, the skids can be pulled away below the raised plough body and replaced with new skids. Each locking means may be such that it can be actuated from the adjacent end face of the plough body.

In a preferred embodiment, each locking means includes a latching element which engages the associated base member, and a releasable locking element for clamping said latching element to said base member. Conveniently, each locking element is constituted by an axially-extending screw-threaded member associated with a threaded bore formed in the associated skid.

Preferably, that end portion of each of the base members of the plough body adjacent to the adjacent end face of the plough body is shaped to define a hinge piece which is pivotally engageable within a hollow seat formed in the respective skid adjacent to one end of the bearing surface of that skid, and the opposite end of each base member is pivotally braced against a cup-shaped support surface formed on said skid adjacent to the other end of said bearing surface. Advantageously, each of the latching elements engages the hinge piece of the associated base member.

As previously mentioned, the base of the plough is supported and guided by the skids on the plough guide, the skids forming a bottom guide means for the plough. The top of the plough may also be guided by means on an upper guide constituted by a guide bar provided at the top of the plough guide, the plough body being provided with replaceable guide members which embrace the guide bar. By means of this arrangement of the skids and the guide members, the plough body itself can virtually be prevented from contacting the plough guide. Thus, wear is concentrated practically exclusively on the skids and the guide members, and these can be easily exchanged when the need arises.

The plough may further comprise a pair of cutter carriers pivotally mounted on the plough body, said carriers being connected by a rod connector. The rod connector is such that, depending upon the direction of travel of the plough, one of the carriers is swung out into a working position, and the other carrier is swung back into an inoperative position. In order to retain a given tool carrier in its working position, and to prevent undesired swinging movements of the carriers, the plough may further comprise a braking device associated with the rod connector. Advantageously, the braking device is constituted by a pair of jaws, and means for pressing the jaws together to grip the rod connector therebetween, said pressing means being adjustable. Alternatively, the braking device is a brake cylinder which is engageable with the rod connector.

The invention also provides a plough installation comprising a plough guide and a mineral winning plough movable to and fro along the plough guide, wherein the plough is as defined above.

Preferably, the plough guide includes a plate for slidably supporting the plough body, the plate being directed towards the face and being supported on the floor of the working, and the plough guide includes a pair of chain ducts for the plough drive chain, the chain ducts being disposed one above the other behind a cover plate which forms part of the plough guide. Advantageously, a slot is provided between the plate and the lower end of the cover plate, the coupling members passing through said slot and extending into the lower chain duct where they are connected to the plough drive chain.

BRIEF DESCRIPTION OF THE DRAWINGS

A coal plough constructed in accordance with the invention will now be described, by way of example, with reference to the accompanying drawings, in which.

DESCRIPTION OF PREFERRED EMBODIMENT

Figure 1:
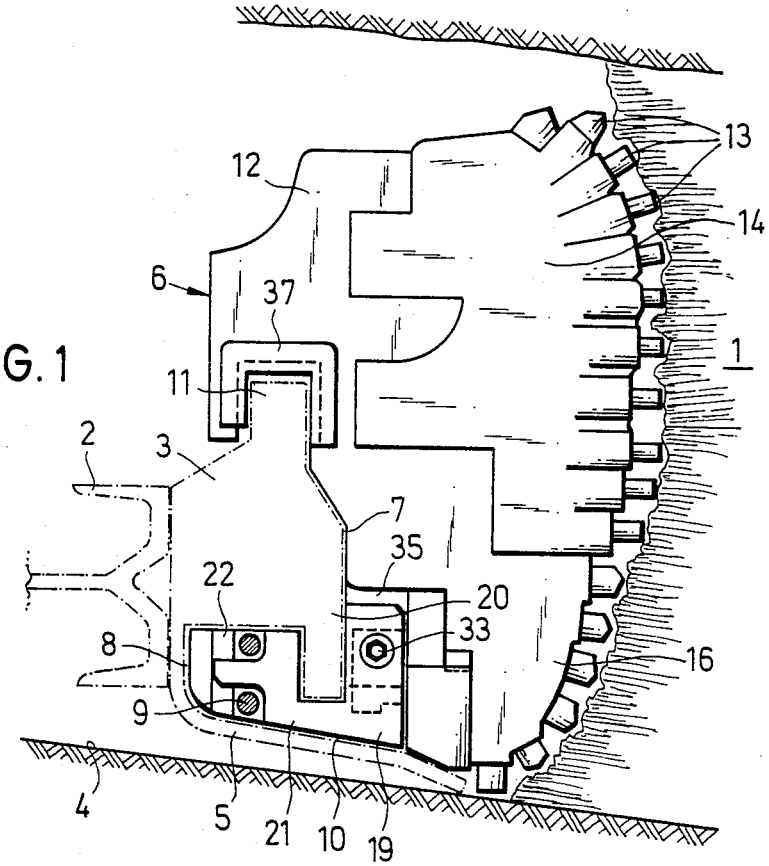
FIG. 1 is a diagrammatic end elevation of the plough, looking in the direction of travel of the plough.

Referring to the drawings, FIG. 1 shows a longwall scraper-chain conveyor 2 disposed alongside a coal face 1, only the face-side lateral profile of the conveyor being shown in FIG. 1. A plough guide 3 is mounted on the face side of the conveyor 2, the guide 3 being indicated in outline only. The plough guide 3 and the conveyor 2 are each constituted by a plurality of individual sections which are joined together end-to-end in such a manner as to permit limited articulation between adjacent sections in the vertical and horizontal directions. The plough guide 3 includes a floor plate 5, which is inclined to the floor 4 of the working at a small angle. The plate 5 defines a plough guide track, along which a plough 6 can slide. The plate 5 also serves to limit the cut of the plough 6 during winning operations. Between the plate 5 and a cover plate 7, the plough guide 3 houses two vertically spaced chain ducts (of which only the lower chain duct 8 can be seen in FIG. 1). An endless plough drive chain 9 is housed within the chain ducts. A continuous slot 10, which is contiguous with the lower chain duct 8, is defined by the plate 5 and the lower end of the cover plate 7, the plough 6 being connected to the plough drive chain 9 via this slot. At its top, the plough guide 3 has an upstanding guide bar 11.

The plough 6 has a plough body 12, which is provided with cutters 13 at both ends. This enables the plough 6 to win coal equally well in both directions of travel. The cutters 13 at each end of the plough body 12 are arranged in echelon formation on respective carriers 14. Each of the carriers 14 is mounted on the plough body 12 for pivotal movement about a respective axis 15. Consequently, each carrier 14 can be swung back from a working position, in which its cutters 13 cut into the face 1 to a predetermined depth, into a non-operative position, in which its cutters are not in contact with the face. In its lower zone, the plough body 12 is provided, at each of its two ends, with a holder 16 which carries a floor cutter 17 and cutters 18. The holders 16 are indicated by dash-dot lines in FIG. 4, and their construction and arrangement are well known. Each of the holders 16 is pivotally mounted on the plough body 12.

The heavy plough body 12 provided with the loosening tools, is supported at each end thereof, by a narrow flat skid 19, on the plate 5 of the plough guide 3. The skids 19 are made of wear-resistant material, and are connected to the plough body 12 in a readily releasable and replaceable manner. The skids 19 do not carry any cutters. As shown in FIG. 1, the vertical dimension of each of the skids 19 is considerably less than that of the plough guide 3, and the width of each of the skids is less than the width of the plate 5.

Each of the skids 19 is connected to the plough body 12 so as to pivot, to a limited extent, in a plane parallel to the floor of the working and in a plane perpendicular to both the floor of the working and the face. As shown in FIG. 1, each of the skids 19 is of complementary shape to a respective lower extension 20 of the cover plate 7 of the plough guide 3, so that the skids embrace the underneath of the plough guide in a shape-locking manner. A respective guide arm 21 is formed integrally with each of the skids 19, the guide arms extending into the lower chain duct 8, and being provided with respective coupling members 22 for connection with the plough drive chain 9.

Figure 3:
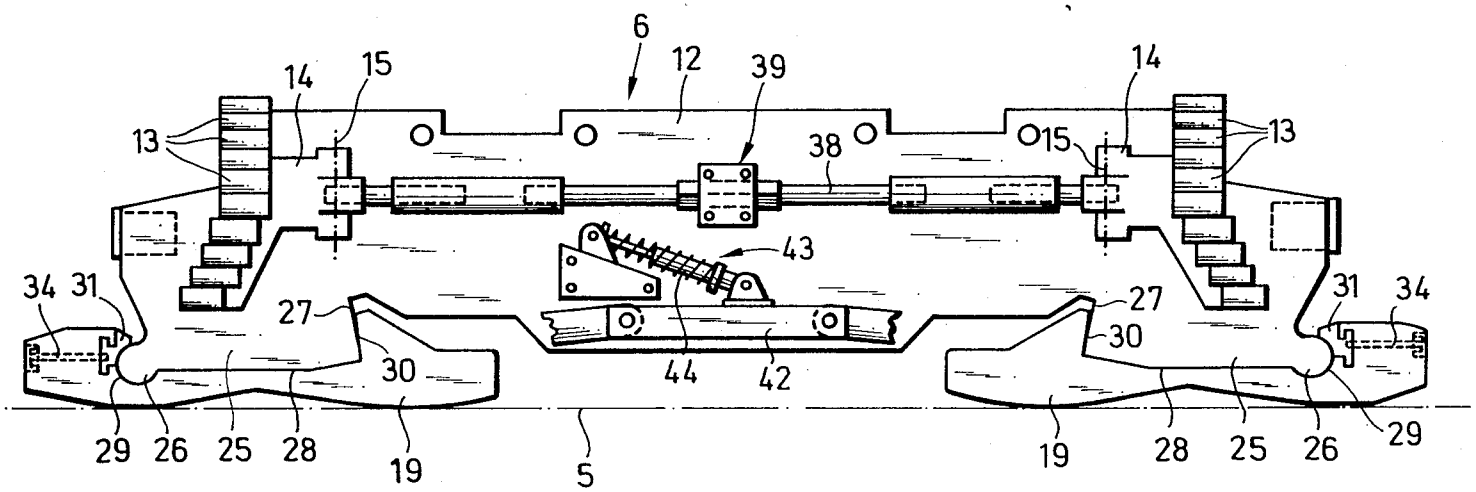
FIG. 3 is a side elevation of the plough, looking from the coal face, the parts of the plough positioned in front of the skids at the ends of the plough body being omitted for reasons of clarity.
Figure 5:
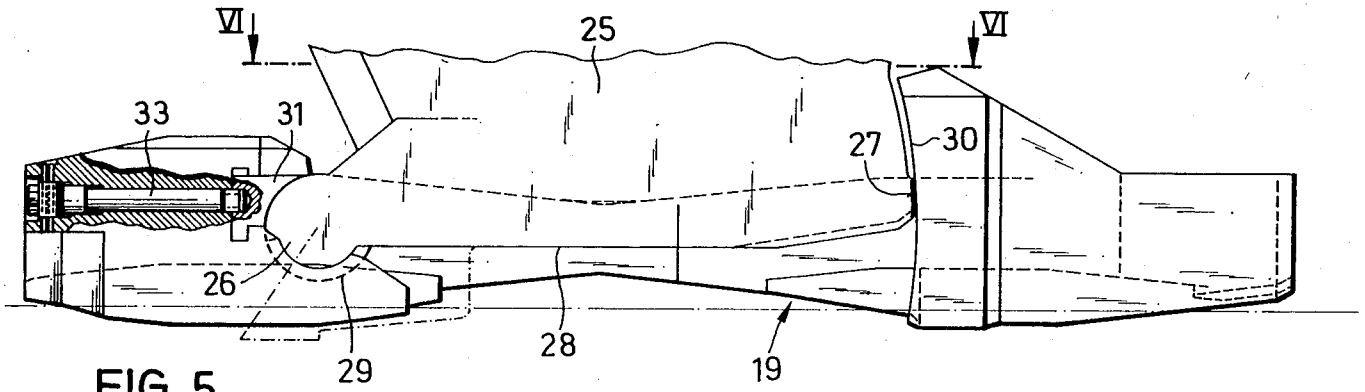
FIG. 5 is an enlarged, part-sectional, side elevation of one of the skids, and the means for connecting it to a base member of the plough body.
Figure 6:
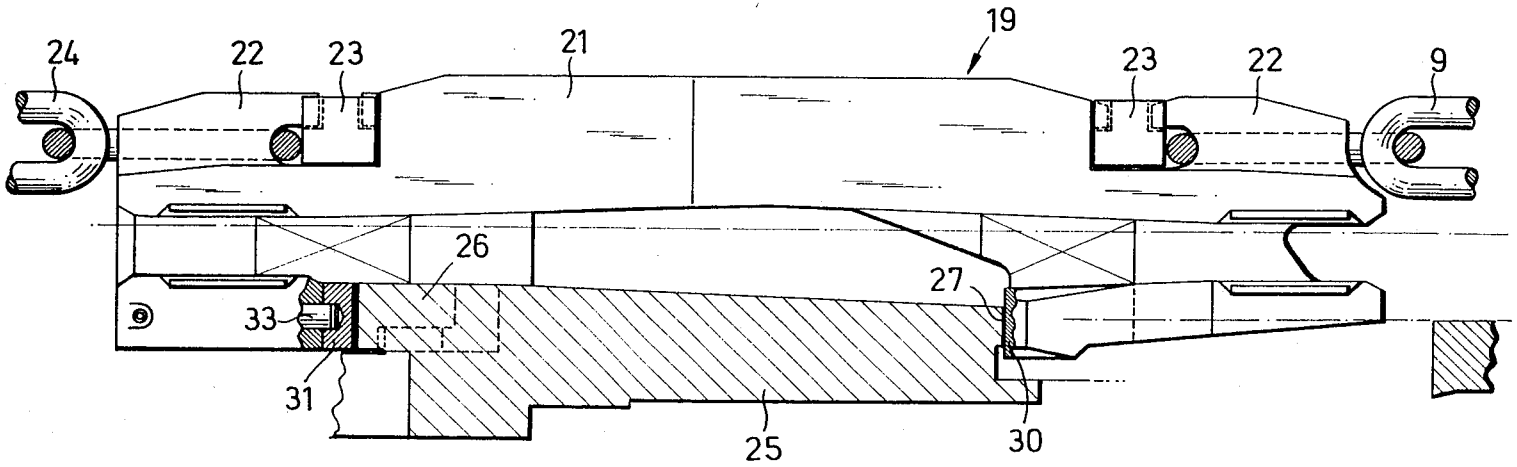
FIG. 6 shows a part-sectional plan view of the arrangement shown in FIG. 5.

FIGS. 5 and 6 show, on a larger scale, the skid 19 which is at the left-hand end (as shown in FIG. 3) of the plough body 12. The coupling member 22 of this skid 19 is generally hook-shaped, so that one end of the plough drive chain 9 can be attached to the coupling member by one of its vertical links, the connection being secured by a releasable locking element 23. The other skid 19 is of similar construction, and the other end of the plough drive chain 9 is connected, in a similar manner, to the coupling member 22 of that other skid. The two skids 19 are interconnected by way of a short length of chain 24, which engages with hook-shaped coupling members 22. Here again, the connections are secured by locking elements 23.

Each end of the plough body 12 includes a downwardly-projecting, narrow base member 25 (see FIGS. 3 and 4), which is shaped to define a cylindrical (or slightly barrelled) hinge piece 26 at that of its ends presented to the adjacent end-face of the plough 6. At its end remote from its hinge piece 26, each base member 25 has a slightly barrelled support face 27. Each of the skids 19 is formed with an open-topped bearing surface 28 for receiving the associated plough body base member 25. A hollow hinge seat 29 is formed at that end of each bearing surface 28 adjacent to the end of the plough 6. At its other end, each of the bearing surfaces 28 has a cup-shaped support face 30 for the associated base member 25. In order to connect the skids 19 to the plough body 12, the base members 25 are introduced into the bearing surfaces 28 of the skids, the hinge pieces 26 engaging in the hollow seats 29, and the barrelled support faces 27 of the base members 25 being braced at the rear against the cup-shaped support faces 30. In order to secure the connection between each of the skids 19 and the plough body 12, a respective T-shaped latching element 31 is slid into a T-shaped channel 32 formed in that skid, the latching elements being held fast by axially-extending screws 33. The latching elements 31 ensure that the hinge pieces 26 engage firmly in the hollow seats 29. The screws 33 are screwed, from the adjacent end face of the plough 6, into axial bores 34 in the skids 19 and into threaded bores provided in the latching elements 31. In this way, the skids 19 are connected to the plough body 12 in the plane perpendicular to both the floor of the working and the face 1. The skids 19 are, however, connected to the base members 25 of the plough body 12 in such a manner that they can pivot to a limited extent in the plane parallel to the floor. Moreover, the skids 19 are braced by their support faces 30 against the support faces 27 of the base members 25. The central pivotal points of these faces 27 and 30 coincide with the centre-points of the hollow seats 29. Thus, the traction force of the plough drive chain 9 is always transmitted to the associated base member 25, and to the plough body 12 by way of the support face 30 of the skid 19 that leads in the direction of travel of the plough 6.

Figure 2:
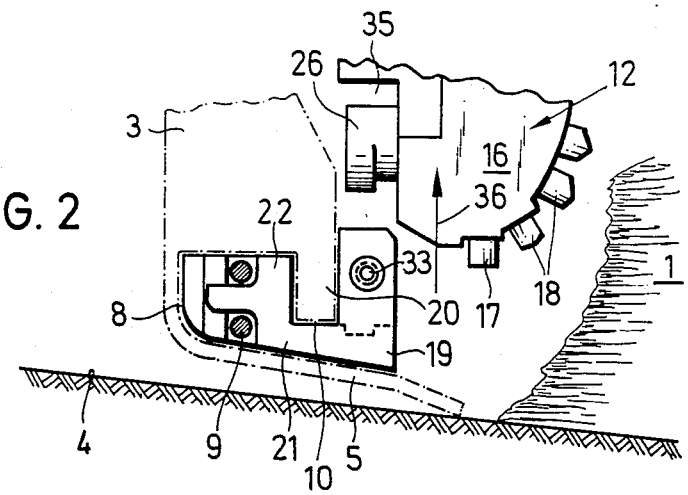
FIG. 2 shows part of the plough of FIG. 1, and indicates the procedure for changing the skids of the plough.

As shown in FIGS. 1 and 2, the rear, base portion of the plough body 12 is provided with recesses 35 for accommodating the skids 19. The recesses 35 are open towards the lower face of the plough body 12, and towards the plough guide 3. The base members 25 are disposed within the recesses 35, and are there connected to the two skids 19 as described above. The plough body 12 thus overlaps the skids 19 on the face side. The face side of the plough body 12 is provided with arcuate guides (not shown), known per se, for the holders 16, the arcuate guides being positioned in front of the recesses 35.

It will be appreciated that, during operation of the plough 6, wear is concentrated on the skids 19, by way of which the plough is supported on the plate 5, and which skids also guide the plough body 12 in the lower zone of the plough guide 3. To enable worn skids 19 to be replaced, the screws 33 are loosened. Then, the entire plough body 12, with the cutters mounted thereon, is lifted away from the skids 19 in the direction indicated by the arrow 36 with the aid of, for example, lifting tackle. The skids 19 can then be pulled away, from below the plough body 12, by means of the plough drive chain 9, and can be replaced.

As previously mentioned, the plough body 12 is also guided in the top zone of the plough guide 3 on the guide bar 11. U-shaped guide members 37 are releasably secured to the plough body 12, the U-shaped guide members overlying and embracing the guide bar 11. These guide members 37 can also be readily replaced when they become worn.

Figures 4, 7:
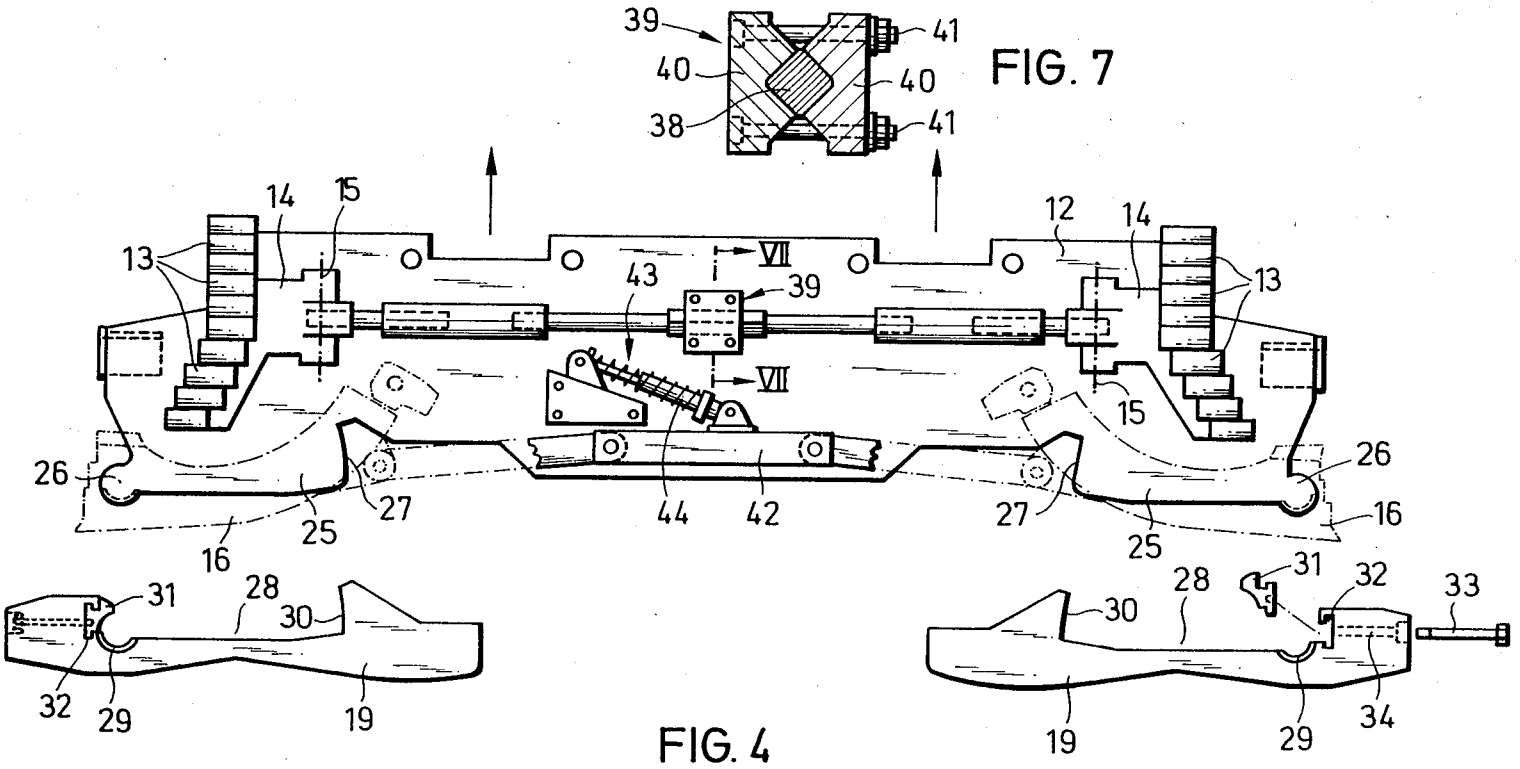
FIG. 4 is a view similar to that of FIG. 3, but showing the skids released from the plough body.
FIG. 7 is a cross-section taken on the line VII—VII of FIG. 4, and shows a brake device.

As shown in FIGS. 3 and 4, the two carriers 14 are coupled together by rod connector 38; so that, when one of the carriers is swung out into a working position (in which its cutters 13 are in contact with the face 1), the other carrier is swung back into a non-working position (in which its cutters 13 are not in contact with the face). In order to prevent undesirable swinging movements of the carriers 14 during operation of the plough 6, and to hold the leading carrier in its working position, a braking device 39 is provided. As shown in FIG. 7, the braking device 39 consists of a pair of jaws 40, which can be pressed towards the rod connector 38 by means of screws 41, so that they exert a predetermined braking action on the rod connector. This braking action can be varied by adjusting the screws 41.

As shown in FIG. 4, the two holders 16, can be connected in a similar manner by a rod connector 42, with which is associated a braking device, constituted by a spring-loaded brake cylinder 44. Alternatively, the braking device 44 could be a hydraulic brake cylinder, wherein hydraulic fluid is throttled from one of the working chambers into the other so as to achieve braking. It would also be possible for the braking device 39 to be a spring-loaded brake cylinder or a hydraulic brake cylinder.

We claim:

1. A plough installation comprising a plough guide and a mineral winning plough movable to and fro along the plough guide, the plough having an elongate plough body provided with cutters, wherein the plough body is provided with a pair of wear-resistant skids which are positioned at the end portions of the plough body and which, in use, make sliding engagement with the plough guide, each of the skids being connected to the plough body by releasable locking means, whereby the plough body can be lifted away from the skids when the locking means are released.

2. An installation according to claim 1, wherein each of the skids is pivotally connected to the plough body for pivotal movement about an axis parallel to the longitudinal axis of the plough body.

3. An installation according to claim 1, wherein a respective coupling member is formed integrally with each of the skids, the coupling members constituting means for connecting the plough to a plough drive chain.

4. An installation according to claim 3, wherein the plough guide includes a plate for slidably supporting the plough body, the plate being directed towards the face and being supported on the floor of the working, and wherein the plough guide includes a pair of chain ducts for the plough drive chain, the chain ducts being disposed one above the other behind a cover plate which forms part of the plough guide.

5. An installation according to claim 4, wherein a slot is provided between the plate and the lower end of the cover plate, the coupling members passing through said slot and extending into the lower chain duct where they are connected to the plough drive chain.

6. An installation according to claim 1, wherein the plough body has recesses for accommodating the skids, the recesses being open towards the lower face of the plough body.

7. An installation according to claim 1, wherein the plough body overlaps the skids at the face side.

8. An installation according to claim 6, wherein the recesses in the plough body are also open towards that of its sides presented to the plough guide.

9. An installation according to claim 1, wherein each of the skids includes an open-topped bearing surface which engages a respective base member of the plough body.

10. An installation according to claim 1, wherein each locking means includes a latching element which engages the associated base member, and a releasable locking element for clamping said latching element to said base member.

11. An installation according to claim 10, wherein each locking element is an axially-extending screw-threaded member associated with a threaded bore formed in the associated skid.

12. An installation according to claim 10, wherein each locking element is such that it can be actuated from the adjacent end face of the plough body.

13. An installation according to claim 10, wherein that end portion of each of the base members of the plough body adjacent to the adjacent end face of the plough body is shaped to define a hinge piece which is pivotally engageable within a hollow seat formed in the respective skid adjacent to one end of the bearing surface of that skid, and wherein the opposite end of each base member is pivotally braced against a cup-shaped support surface formed on said skid adjacent to the other end of said bearing surface.

14. An installation according to claim 13, wherein each of the latching elements engages the hinge piece of the associated base member.

15. An installation according to claim 1, further comprising a pair of cutter carriers pivotally mounted on the plough body, said carriers being connected by a rod connector.

16. An installation according to claim 15, further comprising a braking device associated with the rod connector.

17. An installation according to claim 16, wherein the braking device comprises a pair of jaws, and means for pressing the jaws together to grip the rod connector therebetween.

18. An installation according to claim 17, wherein said pressing means is adjustable.

19. An installation according to claim 16, wherein the braking device is a brake cylinder which is engageable with the rod connector.

20. An installation according to claim 1, wherein each of the skids has a vertical dimension which is considerably less than the vertical dimension of the plough guide.

21. An installation according to claim 1, wherein each of the skids embraces the lower portion of the plough guide in a shape-locking manner.

22. An installation according to claim 1, wherein a guide bar is provided at the top of the plough guide, and wherein the plough body is provided with replaceable guide members which embrace the guide bar.

23. A plough installation comprising a plough guide and a mineral winning plough movable to and fro along the plough guide, the plough having a plough body provided with cutters on cutter carriers pivotally mounted on the plough body, said carriers being connected by a rod connector having a braking device associated therewith, and wherein the plough body is provided with detachable, wear-resistant skid means which, in use, make sliding engagement with the plough guide.

* * * * *